US010364715B2

(12) United States Patent
Lee

(10) Patent No.: US 10,364,715 B2
(45) Date of Patent: Jul. 30, 2019

(54) SLIP-TYPE ACTIVE NOISE CONTROL MUFFLER AND METHOD FOR CONTROLLING THE SAME

(71) Applicant: Hyundai Motor Company, Seoul (KR)

(72) Inventor: Sang-Ho Lee, Andong-si (KR)

(73) Assignee: Hyundai Motor Company, Seoul (KR)

( * ) Notice: Subject to any disclaimer, the term of this patent is extended or adjusted under 35 U.S.C. 154(b) by 173 days.

(21) Appl. No.: 15/355,668

(22) Filed: Nov. 18, 2016

(65) Prior Publication Data

US 2017/0335729 A1 Nov. 23, 2017

(30) Foreign Application Priority Data

May 23, 2016 (KR) ..... 10-2016-0062634

(51) Int. Cl.
*F01N 1/16* (2006.01)
*F01N 1/08* (2006.01)
*G10K 11/178* (2006.01)

(52) U.S. Cl.
CPC ..... *F01N 1/166* (2013.01); *F01N 1/083* (2013.01); *F01N 1/161* (2013.01); *F01N 1/168* (2013.01); *G10K 11/17861* (2018.01); *G10K 11/17873* (2018.01); *F01N 2490/18* (2013.01); *G10K 2210/12822* (2013.01)

(58) Field of Classification Search
CPC ..... F01N 1/166; F01N 1/083; F01N 1/161; F01N 1/168; F01N 2490/18; G10K 11/17861; G10K 11/17873; G10K 2210/12822
USPC ..... 181/277, 278
See application file for complete search history.

(56) References Cited

U.S. PATENT DOCUMENTS 4,428,453 A * 1/1984 Yuen ..... F01N 1/14 181/212
5,475,189 A * 12/1995 Field ..... F16L 55/0333 181/241
6,901,752 B2 * 6/2005 Uhler ..... F01N 1/02 181/215
7,117,974 B2 * 10/2006 Moenssen ..... F02M 35/1216 181/277
7,337,877 B2 * 3/2008 Goenka ..... F02M 35/1261 123/184.56

(Continued)

FOREIGN PATENT DOCUMENTS

KR 20-1998-044270 U 9/1998
KR 1998-050753 U 10/1998

(Continued)

*Primary Examiner* — Forrest M Phillips
(74) *Attorney, Agent, or Firm* — Morgan, Lewis & Bockius LLP

(57) ABSTRACT

A slip-type active noise control muffler reducing exhaust noise of a vehicle may include at least two guides connected to an inner wall of a housing accommodating exhaust gas in the muffler and formed in a pipe shape in a longitudinal direction of the muffler, and a baffle positioned in a plane shape partitioning the interior of the housing and including an electromagnet on the plane shape to control an interval of the baffles through a movement signal by current applied to the electromagnet according to frequency calculated from the exhaust gas, in which the interval of the baffles may be controlled and the exhaust noise may be reduced by controlling the number of wavelengths depending on the frequency.

8 Claims, 5 Drawing Sheets

(56) References Cited

U.S. PATENT DOCUMENTS

| | | | | |
|---|---|---|---|---|
| 8,931,589 | B2 * | 1/2015 | Bothien | F23M 99/005 181/219 |
| 2005/0155816 | A1 * | 7/2005 | Alcini | F01N 1/163 181/237 |
| 2005/0205354 | A1 * | 9/2005 | Goenka | F02M 35/1261 181/277 |
| 2007/0023230 | A1 * | 2/2007 | Nakayama | F02M 35/1255 181/276 |
| 2007/0246294 | A1 * | 10/2007 | Willey | F01N 1/082 181/254 |

FOREIGN PATENT DOCUMENTS

| | | | |
|---|---|---|---|
| KR | 20-1999-0039683 | U | 11/1999 |
| KR | 10-2006-0031216 | A | 4/2006 |
| KR | 10-2008-0049493 | A | 6/2008 |

* cited by examiner

SLIP-TYPE ACTIVE NOISE CONTROL MUFFLER AND METHOD FOR CONTROLLING THE SAME

CROSS-REFERENCE TO RELATED APPLICATIONS

The present application claims priority to Korean Patent Application No. 10-2016-0062634, filed May 23, 2016, the entire contents of which is incorporated herein for all purposes by this reference in its entirety.

BACKGROUND OF THE INVENTION

Field of the Invention

The present invention relates to a slip-type active noise control muffler a method for controlling the same, and particularly, to an apparatus for reducing noise by analyzing a frequency of exhaust gas and a method for controlling the same.

Description of Related Art

In general, a muffler as an apparatus for reducing exhaust noise generated from rapid expansion of exhaust air is used while being mounted on an exhaust system of a vehicle or an industrial machine. The muffler generally includes a body having a hollow, a partition partitioning an inner space of the body into a plurality of spaces and having a plurality of vent holes, an inflow pipe guiding the exhaust gas in the exhaust system to the body, and a discharge pipe discharging the exhaust gas in the body. Therefore, the exhaust gas of the exhaust system is input through an inlet pipe and discharged to the outside through the discharge pipe via a plurality of vent holes of the partition. However, since the sizes and layout of the plurality of vent holes are fixed, a flow of the exhaust gas depending on an engine's revolutions per minute (RPM) cannot be controlled.

In this regard, a conventional muffler includes a body case connected between an intake pipe and an end pipe of the exhaust gas and allows one of baffles partitioning the inner space of the body case into multiple cells to move in forward and backward directions along the body case with a change in exhaust pressure. Further, at least one variable baffle is slidably installed in the body case and is elastically supported with a spring interposed between the one variable baffle and the other baffle. According to such a configuration, disclosed is a technology that the variable baffle varies the space of the muffler to actively cope with the high exhaust pressure when the exhaust pressure is high.

However, in the conventional muffler, a fixed baffle is moved in order to offset noise and the movement occurs according to the exhaust pressure and is substantially irrelevant to a principle of the noise generated from the exhaust gas. Therefore, when the baffle moves only by the pressure, the exhaust noise still exists.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY

Various aspects of the present invention are directed to providing an apparatus for fundamentally reducing exhaust noise which cannot be solved in the existing muffler.

Additionally, various aspects of the present invention are directed to providing a control method for reducing noise of exhaust gas by specifically analyzing a cause which brings about the exhaust noise.

According to various aspects of the present invention, a slip-type active noise control muffler reducing exhaust noise of a vehicle may include at least two guides connected to an inner wall of a housing accommodating exhaust gas in the muffler and formed in a pipe shape in a longitudinal direction of the muffler, and a baffle positioned in a plane shape partitioning the interior of the housing and including an electromagnet on the plane shape to control an interval of the baffles through a movement signal by current applied to the electromagnet according to frequency calculated from the exhaust gas, in which the interval of the baffles may be controlled and the exhaust noise may be reduced by controlling the number of wavelengths depending on the frequency.

The guide may have a predetermined volume in a pipe-shaped interior and further include a lubricating liquid filled in the volume, and the lubricating liquid may be released to an outside of the guide to reduce friction force of horizontal movement of the baffle when a movement signal is input into the electromagnet.

The frequency may be calculated by considering transmission loss (TL) from a cross-sectional area of the housing.

The housing may include an inflow hole pipe and an outflow hole pipe therein, and the wavelength may be determined from a speed and an absolute temperature of the exhaust gas which flows into the inflow hole pipe.

The baffle may control the interval partitioned as the periphery of the plane is connected to the guide to move horizontally in a longitudinal direction of the guide.

At least one electromagnet may be disposed on at least one of a top or a bottom of the baffle and a polarity of the electromagnet may be able to vary depending on the movement signal.

The polarity may be set to decrease the interval of the baffles when the frequency of the exhaust gas is higher than a predetermined reference value and set to increase the interval of the baffles when the frequency of the exhaust gas is lower than the predetermined reference value.

The movement signal may be applied to the electromagnet in real time as the frequency of the exhaust gas is changed.

According to various aspects of the present invention, a method for controlling a slip-type active noise control muffler reducing exhaust noise of a vehicle may include determining, by an electronic control unit (ECU), a frequency of exhaust gas by analyzing a cross-sectional area of the muffler and a flow, a speed, and an absolute temperature of the exhaust gas which flows into the muffler, changing, by the ECU, a polarity of an electromagnet disposed in a baffle according to a movement signal by comparing the frequency and a predetermined reference value, and reducing, by the ECU, the exhaust noise by controlling an interval of the baffles.

According to various embodiments of the present invention, cost is reduced by separate nose reducing equipment that reduces noise only by movement of the existing baffle by analyzing a frequency band of exhaust gas.

Exhaust noise is actively reduced by measuring a frequency of the exhaust gas in real time and controlling a baffle interval using an electromagnet.

It is understood that the term "vehicle" or "vehicular" or other similar terms as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuel derived from resources other than petroleum). As referred to herein, a hybrid vehicle is a vehicle that has two or more sources of power, for example, both gasoline-powered and electric-powered vehicles.

The methods and apparatuses of the present invention have other features and advantages which will be apparent from or are set forth in more detail in the accompanying drawings, which are incorporated herein, and the following Detailed Description, which together serve to explain certain principles of the present invention.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that the present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Figure 1:
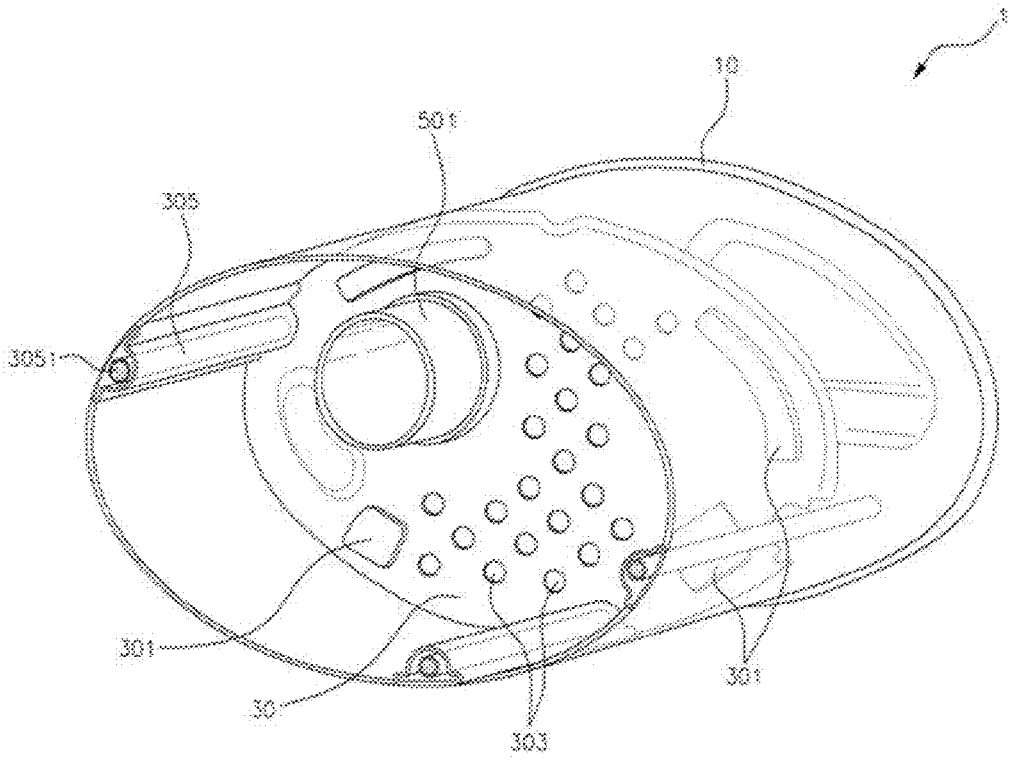
FIG. 1 illustrates a slip-type active noise control muffler according to various embodiments of the present invention.

FIG. 1 illustrates a slip-type active noise control muffler 1 according to various embodiments of the present invention. Referring to FIG. 1, the muffler 1 may include a guide 305 and a baffle 30 as primary components.

At least two guides 305 are connected to an inner wall of a housing 10 accommodating exhaust gas in the muffler 1 and have a pipe shape in the longitudinal direction of the muffler 1. When the baffle 30 moves horizontally, the guide 305 may be installed to penetrate the circumference of the baffle 30 in order to provide a path of the movement. When the baffle 30 moves, since the baffle 30 moves in the longitudinal direction of the guide 305, the guide 305 may be installed vertical to a plane of the baffle 30.

A primary purpose of the muffler 1 used in a general exhaust system is to reduce energy and most mufflers having the purpose serve to absorb sound energy or reduce the intensity of an input wavelength and in various embodiments of the present invention, such an effect of the muffler may be implemented by controlling an interval of the baffles 30, e.g., by an electronic control unit (ECU), the electronic control unit being known to a person skilled in the art, therefore a detailed description thereof shall be omitted.

An operation of the muffler 1 adopts a principle in which when a pressure wavelength flows in a predetermined direction at a given frequency and with a given amplitude and the same wavelength flows in an opposite direction to the first wavelength, two wavelengths collide with each other, and as a result, energy of both wavelengths are offset and the amplitude is significantly reduced and while the exhaust gas which enters the muffler 1 is extended and compressed, the pressure wavelength itself is sent backward again, and as a result, both wavelengths collide with each other, thereby reducing a noise level.

The guide 305 is installed in the pipe shape and has a predetermined volume therein, and may further include a lubricating liquid 3051 filled in the volume. When a movement signal of the baffle 30 is sensed, the lubricating liquid 3051 may serve to reduce friction force of the horizontal movement of the baffle 30 as being released to the outside of the guide 305.

The baffle 30 is positioned in a plane shape partitioning the interior of the housing 10 and includes an electromagnet 301 on the plane, and as a result, the interval of the baffles may be controlled by a movement signal by current applied to the electromagnet 301 according to the frequency calculated from the exhaust gas. The baffle 30 may be configured by a plate, that is, in the plane shape and may slide on the inner wall of the muffler body in the longitudinal direction.

An outer diameter of the plane of the baffle 30 may be disposed in the inner wall of the housing 10 in the muffler and a minute interval may be present and this interval may be determined within a minimum range for achieving a slidable structure.

In the case of the baffle 30, the periphery of the plane is connected to the guide 305 to move horizontally in the longitudinal direction of the guide 305, thereby controlling the partitioned interval. The plane of the baffle 30 may include a positioning bolt on the circumference thereof and is preferably installed in a symmetric structure vertically or horizontally so as to smoothly slide without interference on the inner wall of the housing 10, but various embodiments of the present invention are not limited thereto.

The baffle 30 may be coupled to the top of one side wall of the housing 10 as illustrated in FIG. 1, but the baffle 30 may have a structure in which the baffle is formed to be directly processed on the housing 10 wall.

Figure 2:
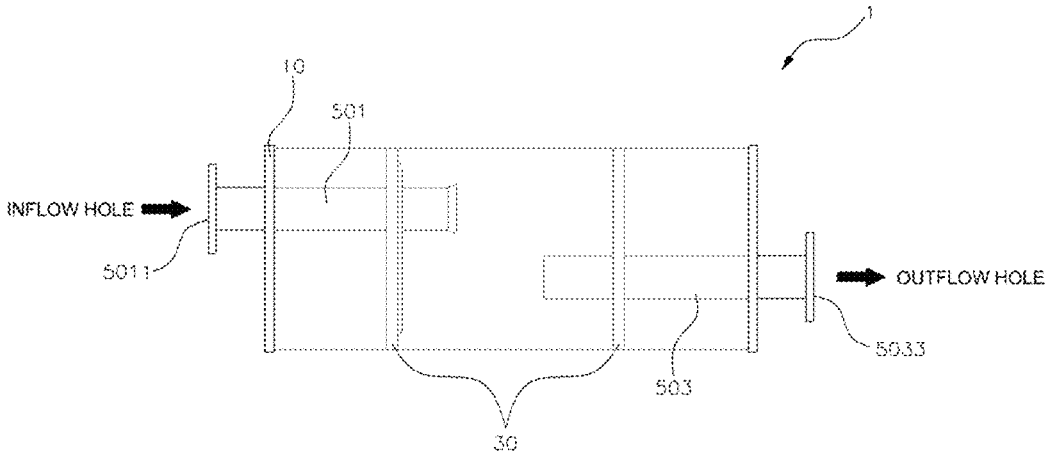
FIG. 2 is a cross-sectional view of the muffler according to various embodiments of the present invention.

FIG. 2 is a cross-sectional view of the muffler 1 according to various embodiments of the present invention. Referring to FIG. 2, the exhaust gas is input through an inflow hole 5011 and output through an outflow hole 5033, and as a result, the exhaust gas may move in a space between the baffles 30 and the exhaust noise may be generated through the frequency of the exhaust gas passing through the inflow hole 5011.

The exhaust gas may enter the muffler 1 body through an inflow hole pipe 501. The exhaust gas may flow in the interior partitioned by the baffle 30 adjacent to the inflow hole pipe 501 and thereafter, may be diffused to the baffle adjacent to an outflow hole pipe 503 and released to the outflow hole pipe 503. The exhaust gas input into the inflow hole 5011 of the muffler 1 may be discharged to the outflow hole 5033 of the muffler 1 by passing through multiple pores 303 formed in the baffle.

Figure 3:
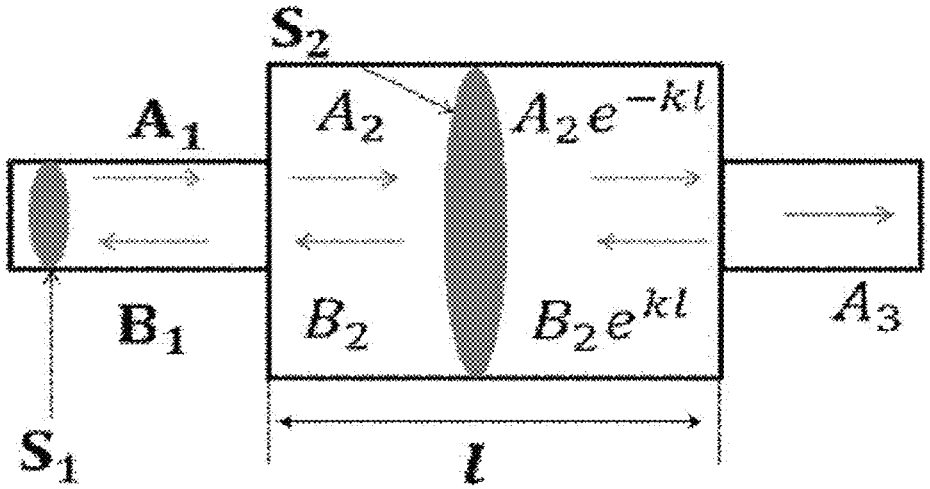
FIG. 3 illustrates a case of calculating transmission loss (TL) according to various embodiments of the present invention.

FIG. 3 illustrates a case of calculating transmission loss (TL) according to various embodiments of the present invention. Referring to FIG. 3, an internal shape of the housing 10 is illustrated and the frequency of the exhaust gas may be calculated from a cross-sectional area of the housing 10 according to a 1D energy conservation law.

[Equation 1]

$$A_1+B_1=A_2+B_2 \quad ①$$

$$S_1(A_1-B_1)=S_2(A_2-B_2) \quad ②$$

$$A_2e^{-kl}+B_2e^{kl}=A_3 \quad ③$$

$$m(A_2e^{-kl}-B_2e^{kl})=A_3 \quad ④$$

In [Equation 1] given above, A1 represents a negative pressure of the inflow hole 5011, A2 represents the negative pressure in the baffle 30, A3 represents the negative pressure of the outflow hole 5033, B1 represents the negative pressure half-waved at the inflow hole 5011, B2 represents the negative pressure half-waved in the baffle 30, and m represents an expansion ratio of S1 and S2.

In the above equation, when Equations (1) to (4) are combined, values may be calculated as shown in [Equation 2] given below.

[Equation 2]

$$\therefore \frac{A_1}{A_3} = \cos kl + j\frac{1}{2}\left(m+\frac{1}{m}\right)\sin kl$$

$$\left|\frac{A_1}{A_3}\right|^2 = 1+\frac{1}{4}\left(m-\frac{1}{m}\right)^2\sin^2 kl$$

(Where, k as a wave number represents the number of wavelengths in 1 m.)

In [Equation 2] given above, L represents the interval of the baffles 30, that is, a displacement of the exhaust gas wavelength. The transmission loss (TL) may be measured at a ration of the negative pressure generated from the cross-sectional area as shown in [Equation 3] and [Equation 4] given below. When the transmission loss (TL) is calculated, the exhaust noise may be measured at the frequency through the displacement of the housing 10, and as a result, a method for reducing the exhaust noise may be devised.

[Equation 3]

$$TL = 10\log_{10}\left|\frac{A_1}{A_3}\right|^2$$

$$TL = 10\log_{10}1+\frac{1}{4}\left(m-\frac{1}{m}\right)^2\sin^2 kl$$

[Equation 4]

$$k(\text{Wave number, the number of wavelengths in 1 m}) = \frac{1}{\lambda} = \frac{2\pi f}{c}$$

$$c = \frac{332\sqrt{1+\frac{T(\text{Absolute temperature of exhaust gas})}{273}}}{(1-MACH\ \text{Match number})}$$

$$MACH\ \text{Match number} = \frac{\text{Speed of exhaust gas}}{340\ m/s} = \frac{0.054\ m/s}{340\ m/s} = 0.00015$$

$$k = 0.9199$$

When the cross-sectional area of the inflow hole pipe 501 is S1, the cross-sectional area of the housing 10 body is S2, and in various embodiments of the present invention, S1=2873 $mm^2$, S2=11627 $mm^2$, m=4.04, and k=0.9199 are set, the transmission loss (TL) may be calculated as 2.1 dB and 1.8 dB may be calculated at 75 Hz. Therefore, a muffler 1 length or the baffle 30 interval may be set in order to catch the corresponding frequency band.

As described above, the housing 10 may include the inflow hole pipe 501 and the outflow hole pipe 503 therein and the wavelength may be calculated from a speed and an absolute temperature of the exhaust gas which flows into the inflow hole pipe 501. Further, the interval of the baffles 30 may be controlled and the exhaust noise may be reduced by controlling the number of wavelengths depending on the frequency.

Figure 4:
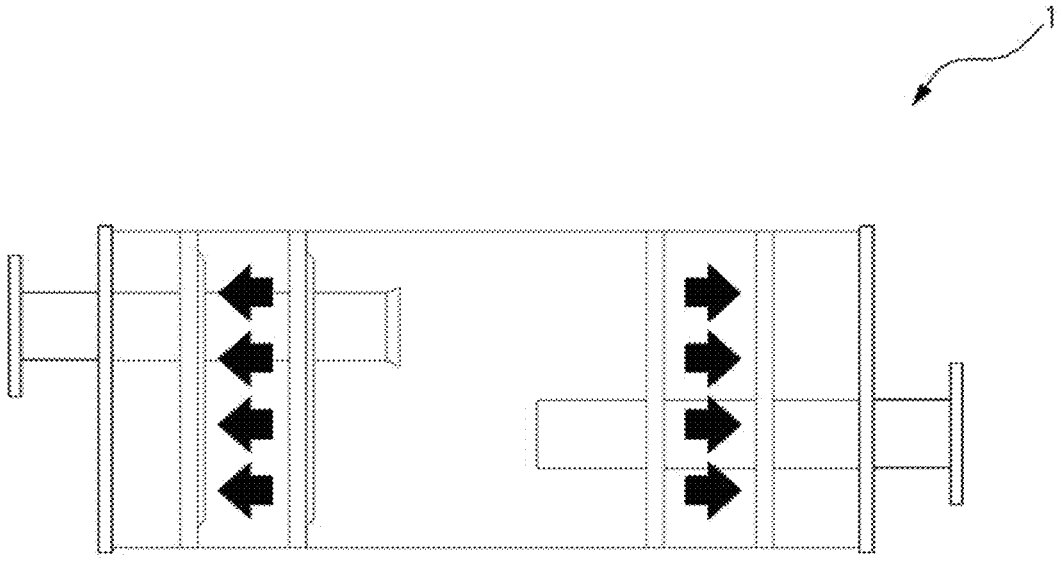
FIG. 4 illustrates a case in which an interval of baffles is controlled according to various embodiments of the present invention.

FIG. 4 illustrates a case in which an interval of baffles 30 is controlled according to various embodiments of the present invention. Referring to FIG. 3, the baffle 30 may include one or more electromagnets 301 on the top or the bottom thereof and the baffle 30 may be driven by not the pressure of the exhaust gas but an electromagnet 301 driving system like the related art.

In the electromagnet 301, the wave number may be determined through the frequency analysis and a driving system of the exhaust gas may control the interval of the baffles 30. A polarity of the electromagnet 301 may vary depending on the movement signal. The polarity of the electromagnet 301 installed in the baffle 30 is set to (+) and (−), and as a result, the polarity may be set to cause attraction force or repulsive force between the baffles 30.

The polarity of the electromagnet 301 may be set to decrease the interval of the baffles 30 when the frequency of the exhaust gas is higher than a predetermined reference value and set to increase the interval of the baffles 30 when the frequency of the exhaust gas is lower than the reference value. In various embodiments of the present invention, the reference value is set to 200 Hz to compare the frequency of the exhaust gas with the reference value. When the frequency of the exhaust gas is more than the reference value, the frequency of the exhaust gas may be classified as a high frequency and when the frequency of the exhaust gas is equal to or less than the reference value, the frequency of the exhaust gas may be classified as a low frequency. However, the claims are not limited thereto and multiple partitions may be set through multiple baffles 30 and a frequency area may be diversified.

The movement signal generated by applying the current to the electromagnet 301 may be applied to the electromagnet 301 in real time as the frequency of the exhaust gas is changed. The frequency analysis may be performed by a predetermined calculation unit, the movement signal calculated based on contents calculated by the calculation unit may be input into the electromagnet 301 or the guide 305 and the input configuration is not limited.

Figure 5:
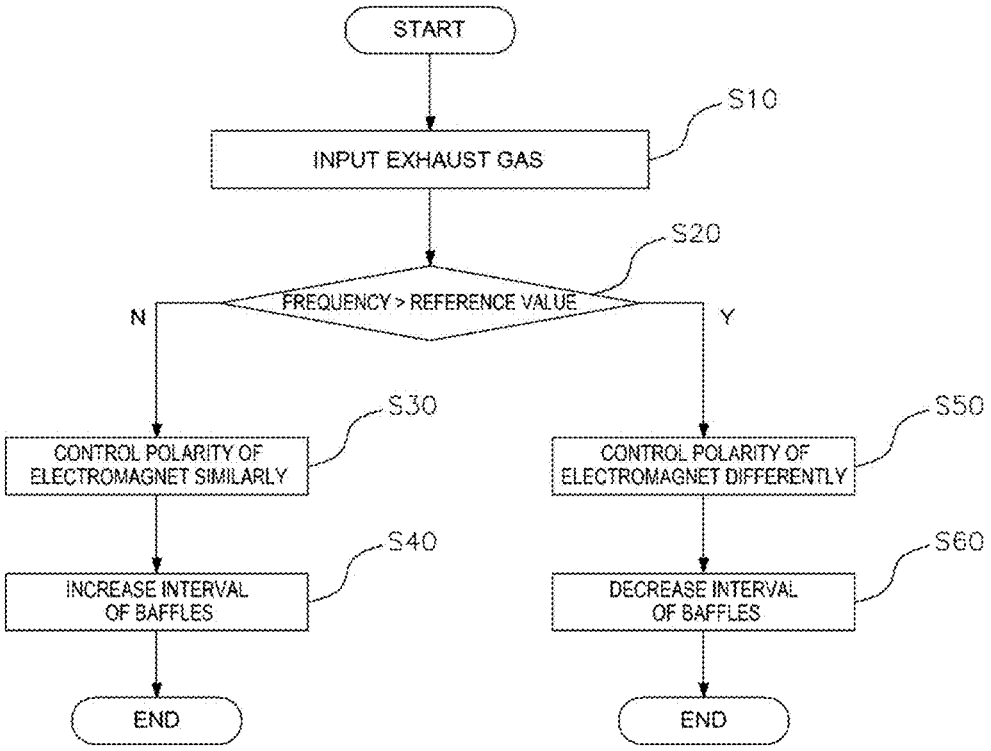
FIG. 5 is a flowchart of a method for controlling a slip-type active noise control muffler according to various embodiments of the present invention.

FIG. 5 is a flowchart of a method for controlling a slip-type active noise control muffler 1 according to various embodiments of the present invention. Referring to FIG. 5, the method for controlling the slip-type active noise control muffler 1, which reduces exhaust noise of a vehicle may include calculating a frequency of exhaust gas by analyzing a cross-sectional area of the muffler 1 and a flow, a speed, and an absolute temperature of the exhaust gas which flows into the muffler 1, changing a polarity of an electromagnet 301 installed in a baffle 30 according to a movement signal by comparing the frequency and a predetermined reference value, and reducing the exhaust noise by controlling an interval of the baffles 30.

Since those skilled in the art may clearly derive matters related with the control method with reference to contents disclosed in the apparatus invention, description thereof will be omitted in the present method invention.

For convenience in explanation and accurate definition in the appended claims, the terms "upper" or "lower", "inner" or "outer" and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A slip-type active noise control muffler reducing exhaust noise of a vehicle, the muffler comprising:

at least two guides connected to an inner wall of a housing accommodating exhaust gas in the muffler and formed in a pipe shape in a longitudinal direction of the muffler; and baffles positioned in a plane shape partitioning the interior of the housing and including an electromagnet on the plane shape to control an interval of the baffles through a movement signal by current applied to the electromagnet according to frequency determined from the exhaust gas, wherein the interval of the baffles is controlled to produce a wavelength in an opposite direction with the frequency and an amplitude of a pressure wave and the exhaust noise is reduced by controlling a number of wavelengths depending on the frequency, wherein the at least two guides are installed to penetrate a circumference of the baffles to provide a path of movement of the baffle, wherein the frequency is determined by considering transmission loss (TL) from a cross-sectional area of the housing, and wherein the transmission loss (TL) is determined by considering a wave number.

2. The slip-type active noise control muffler of claim 1, wherein the at least two guides have a predetermined volume in a pipe-shaped interior and further includes a lubricating liquid filled in the predetermined volume; and the lubricating liquid is released to an outside of the at least two guides to reduce friction force of horizontal movement of the baffles when the movement signal is input into the electromagnet.

3. The slip-type active noise control muffler of claim 1, wherein the housing includes an inflow hole pipe and an outflow hole pipe therein; and the wavelength is determined from a speed and an absolute temperature of the exhaust gas which flows into the inflow hole pipe.

4. The slip-type active noise control muffler of claim 1, wherein the baffles control the interval partitioned as a periphery of the plane shape is connected to the at least two guides to move horizontally in a longitudinal direction of the at least two guides.

5. The slip-type active noise control muffler of claim 1, wherein the electromagnet is disposed on at least one of a top or a bottom of the baffles and a polarity of the electromagnet is configured to vary depending on the movement signal.

6. The slip-type active noise control muffler of claim 5, wherein the polarity is set to decrease the interval of the baffles when the frequency of the exhaust gas is higher than a predetermined reference value and set to increase the interval of the baffles when the frequency of the exhaust gas is lower than the predetermined reference value.

7. The slip-type active noise control muffler of claim 1, wherein the movement signal is applied to the electromagnet in real time as the frequency of the exhaust gas is changed.

8. A method for controlling a slip-type active noise control muffler reducing exhaust noise of a vehicle, the method comprising:

determining, by a controller, a frequency of exhaust gas by analyzing a cross-sectional area of the muffler and a flow, a speed, and an absolute temperature of the exhaust gas which flows into the muffler;

changing, by the controller, a polarity of an electromagnet disposed in baffles according to a movement signal by comparing the frequency and a predetermined reference value; and reducing, by the controller, the exhaust noise by controlling an interval of the baffles, wherein the interval of the baffles is controlled to produce a wavelength in an opposite direction with the frequency and an amplitude of a pressure wave, wherein the frequency is determined by considering transmission loss (TL) from a cross-sectional area of the housing, and wherein the transmission loss (TL) is determined by considering a wave number.

* * * * *